United States Patent [19]

Griffin

[11] 3,990,262

[45] Nov. 9, 1976

[54] NATURAL DRAFT REFRIGERATOR INCLUDING APPARATUS FOR PERMITTING THE CONDENSER TO MOVE BETWEEN A SHIPPING POSITION AND AN IN-USE POSITION

[75] Inventor: James R. Griffin, Louisville, Ky.

[73] Assignee: General Electric Company, Louisville, Ky.

[22] Filed: Dec. 8, 1975

[21] Appl. No.: 638,762

[52] U.S. Cl. ..... 62/295; 165/77; 248/74 R

[51] Int. Cl.[2] ..... F25D 19/00; F28F 7/00

[58] Field of Search ..... 248/61, 74 R; 62/295, 62/298, 448; 165/53, 76, 77

[56] References Cited

UNITED STATES PATENTS

| | | | |
|---|---|---|---|
| 810,004 | 1/1906 | Tabler | 248/61 |
| 1,927,991 | 9/1933 | Pendleton | 165/77 |
| 2,105,751 | 1/1938 | Money | 165/77 |
| 2,797,553 | 7/1957 | Baillif | 62/295 |
| 3,194,524 | 7/1965 | Trumbull | 248/74 |
| 3,297,080 | 1/1967 | Williams et al. | 165/77 |

*Primary Examiner*—Lloyd L. King
*Attorney, Agent, or Firm*—Steven C. Schnedler; Francis H. Boos

[57] ABSTRACT

A natural draft refrigerator includes a condenser holding element which permits the condenser to move between a shipping and storage position, in which the condenser is held closely adjacent the outer rear wall of the refrigerator, and an in-use position, in which the condenser is spaced from the refrigerator rear wall. The refrigerator, therefore, occupies less space during shipping and storage than when in use. In a preferred embodiment of the invention, the holding element includes means for biasing the condenser toward the in-use position and the condenser is releasably held in the shipping and storage position by tape so that, upon installation, the installer simply cuts or removes the shipping tape and the condenser automatically moves rearwardly toward the in-use position.

15 Claims, 8 Drawing Figures

NATURAL DRAFT REFRIGERATOR INCLUDING APPARATUS FOR PERMITTING THE CONDENSER TO MOVE BETWEEN A SHIPPING POSITION AND AN IN-USE POSITION

BACKGROUND OF THE INVENTION

1. Field of the Invention

The present invention relates to a condenser holding apparatus included in a natural draft refrigerator and, more particularly, to such apparatus which permits the condenser to move between a shipping position and an in-use position so that the refrigerator occupies less space when in the shipping condition than it does when in the in-use condition.

2. Description of the Prior Art

Household refrigerators of the natural draft type generally have a condenser extending along the rear outside wall of the refrigerator cabinet and depend upon natural convection currents to provide air circulation past the condenser for carrying heat away from the condenser. Sufficient air space for air circulation around the condenser is critical to most natural draft refrigerator designs. In order to provide sufficient space for air circulation around the condenser, the condenser must be spaced away from the rear wall of the refrigerator. Preferably, there is also provided a wall spacer element attached to the condenser and extending outwardly therefrom away from the rear wall of the refrigerator to provide positive spacing between the condenser and an adjacent wall of the room in which the refrigerator is placed. Additionally, for best air circulation, it is preferable, but not essential, that the condenser be tilted with reference to the rear wall of the refrigerator cabinet, the refrigerator rear wall and the condenser thereby forming a V configuration when viewed from either side of the refrigerator.

In one type of prior art natural draft refrigerator, the bottom of the condenser is held relatively close to the rear wall of the refrigerator and fluid connections between the condenser tubing and the compressor and other apparatus located within the refrigerator cabinet are conveniently made near the bottom of the condenser. The top of the condenser is spaced from and held a further distance from the rear wall of the refrigerator by a unitary holding clip having one end attached to the refrigerator rear wall, an intermediate spacing portion extending between the refrigerator rear wall and the condenser, a holding portion for securely holding the refrigerator condenser in a fixed position, and a further wall spacer portion extending outwardly from the condenser. This unitary holding clip holds the top of the condenser a predetermined distance from the rear wall of the refrigerator and additionally includes a wall spacer to provide positive spacing between the condenser and the adjacent wall of the room.

However, unitary holding clips of the above-described type, by holding the condenser in an in-use position at all times, result in a refrigerator which is unnecessarily bulky during shipping and storage. It is desirable to provide a natural draft refrigerator which takes up less space during shipping and storage than when in use, thereby resulting in a lower carton cost and possibly resulting in a greater number of refrigerators being accommodated by a single railroad car or other conveyance for shipping.

One approach which has been considered for reducing package size during shipping and storage is the provision of a separate shipping clip which would hold the condenser immediately adjacent the refrigerator cabinet during shipping. During installation of the refrigerator, the shipping clip would be removed and replaced with the heretofore described unitary holding clip. However, such an approach is uneconomical because the increased cost in time and labor involved in installing the refrigerator outweigh the advantages of smaller size during shipping and storage.

By the present invention, there is provided a natural draft refrigerator which takes up less space during shipping and in storage than during use, and which may readily be installed with a minimum of installer time and effort.

SUMMARY OF THE INVENTION

Accordingly, it is an object of the invention to provide apparatus for use in a natural draft refrigerator which permits the refrigerator to take up less space during shipping and storage than it does during use.

It is another object of the invention to provide such apparatus which is economical and which requires only a minimal amount of installer time and effort.

These and other objects are accomplished by the invention in which a natural draft refrigerator is provided with a holding element which permits at least one end of the condenser, preferably the top, to move between a shipping and storage position, in which the top of the condenser is close to the refrigerator rear wall, and an in-use position, in which the top of the condenser is away from the refrigerator rear wall. Apparatus, according to the invention, may additionally include a separate wall spacer mounted on the condenser near the top end thereof and extending a preselected distance outwardly therefrom in a direction away from the rear of the refrigerator. A holding element, constructed in accordance with the invention, may include means for biasing the condenser toward the in-use position and the condenser may be adapted to be releasably held in the shipping and storage position by temporary shipping tape so that, upon installation, the installer simply cuts or removes the shipping tape and the condenser automatically moves rearwardly toward the in-use position. Preferably, the holding element, according to the present invention, further includes a means for releasably locking the condenser in the in-use position, which means may comprise a locking element having either a flat or a forked end for contacting one of the tubes of the condenser. The holding element may further include a stop element adapted for contacting the condenser to prevent the condenser from moving closer than the shipping position to the refrigerator outer wall.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DESCRIPTION OF THE PREFERRED EMBODIMENTS

Figure 1:
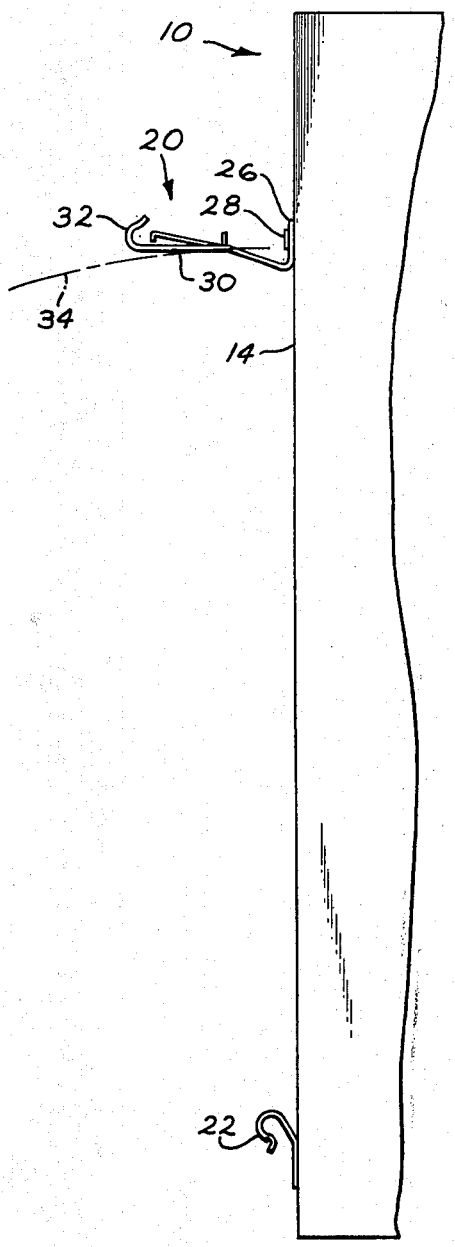
FIG. 1 is a diagrammatic partial side view of a natural draft refrigerator including a resilient condenser holding clip shown in its undeformed position, the condenser being removed for purposes of illustration.

Referring first to FIGS. 1 through 4, there is shown a household refrigerator, generally designated at 10, including a condenser 12 (FIGS. 2–4) located generally adjacent an outer wall of the refrigerator 10, preferably the rear wall 14. The condenser 12 includes tubing 16 for carrying warm refrigerant and a plurality of vertically extending heat exchange members 18 for aiding the transfer of heat from the condenser 12 to the surrounding environment.

Additionally, according to the present invention, the refrigerator 10 includes a condenser holding element, shown as a clip 20, which generally holds the condenser 12, but which permits the top of the condenser 12 to move between a shipping and storage position, hereinafter referred to as "shipping position," (shown in FIGS. 2 and 4), in which the top of the condenser 12 is close to the rear wall 14, and an in-use position (shown in FIG. 3), in which the top of the condenser 12 is farther away from the rear wall 14. In the illustrated embodiment, a condenser pivot 22 is located near the bottom of the condenser 12 and attached to the rear wall 14, the pivot 22 keeping the bottom of the condenser 12 near the rear wall 14. The pivot 22 may be of general channel configuration for receiving and pivotally supporting a section of the condenser tubing 16. It will be apparent that the condenser 12 is tilted with reference to the rear wall 14 when in the in-use position, as is preferable for best air circulation.

The illustrated configuration in which the clip 20 is located near the top of the condenser 12 and the pivot 22 is located near the bottom of the condenser 12 is chosen merely as a matter of convenience because it permits fluid connections between the condenser tubing 16 and other refrigeration apparatus (not shown), located within the refrigerator 10, to be conveniently made near the bottom of the condenser 12. Additionally, such a configuration permits refrigerators including apparatus according to the present invention to be manufactured without requiring a large number of other design changes. It will be appreciated, however, that other configurations may be constructed which embody the principles of the present invention. For example, in a particular refrigerator design, the pivot 22 might be located at the tip of the condenser 12 and the clip 20 might be located at the bottom of the condenser 12. Another example would be a configuration in which condenser holding elements according to the invention would be located at both the top and bottom of the condenser 12, with no pivot at all, so that the entire condenser 12 could move toward and away from the rear wall 14, while remaining substantially parallel to the rear wall 14. Further, the term "rear wall" is not necessarily limited to the actual outer surface of the rear wall 14, but may include internal structural members of the refrigerator 10 to which various elements of the invention are attached. For example, as will be apparent to those skilled in the art, one end of the clip 20 or of the pivot 22 may pass through an aperture in the rear wall 14 and be fastened to an internal structural member (not shown), and the term "rear wall," as used in the specification and claims, is intended to include such an internal structural member.

Figure 4:
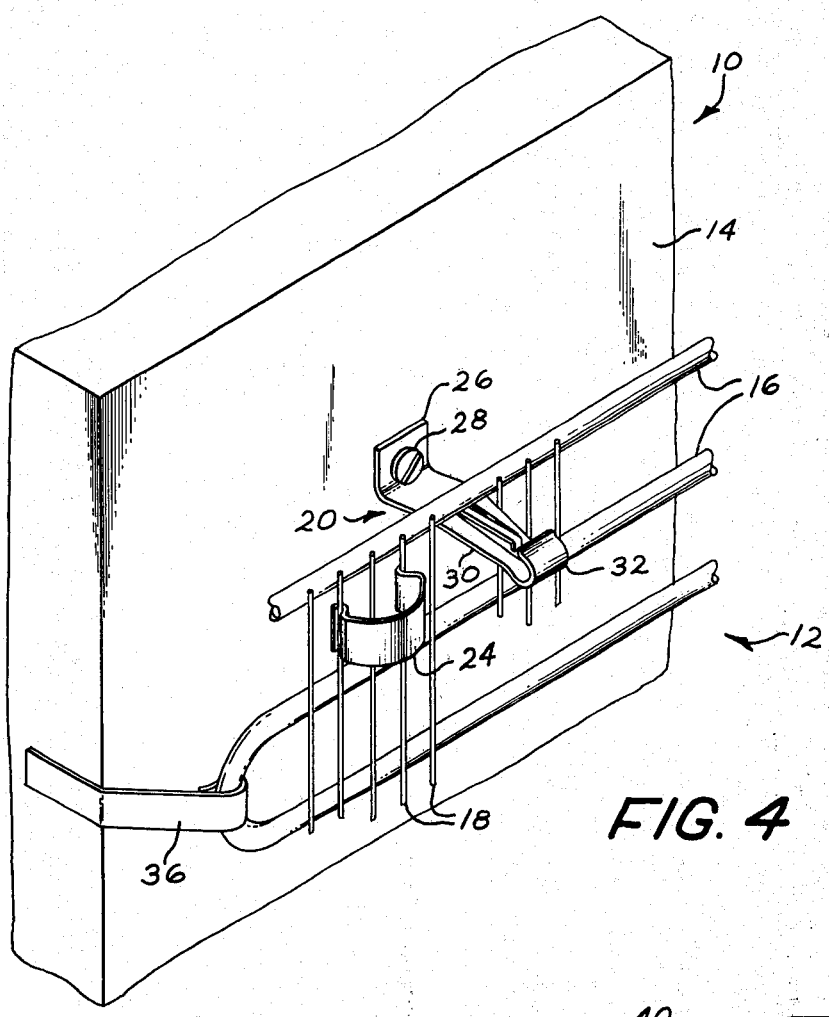
FIG. 4 is a perspective view of the rear of a refrigerator showing a condenser holding clip according to one embodiment of the invention, a wall spacer element, and a piece of temporary shipping tape holding the condenser in the shipping and storage position.

Preferably, in order to provide positive spacing for air circulation between the condenser 12 and the adjacent wall of the room in which the refrigerator 10 is placed, apparatus according to the invention further includes a wall spacer element 24 mounted on the condenser 12 near the top thereof and extending a preselected distance outwardly therefrom in a direction away from the rear wall 14. The preselected distance is preferably at least 0.3 in. The wall spacer 24 can be of various configurations. The preferred embodiment, as best seen in FIG. 4, is resilient leaf spring of arcuate configuration having channels formed at the ends for receiving and connecting the spacer 24 to the heat exchange members 18.

It will be apparent that the embodiments of the invention heretofore described permit the condenser 12 to move between a shipping position, in which the condenser is close to the refrigerator rear wall 14, and an in-use position, in which the condenser is away from the refrigerator rear wall 14, whereby the refrigerator takes up less space during shipping than it does during use. Further features of a preferred embodiment of the invention are described below.

Figure 2:
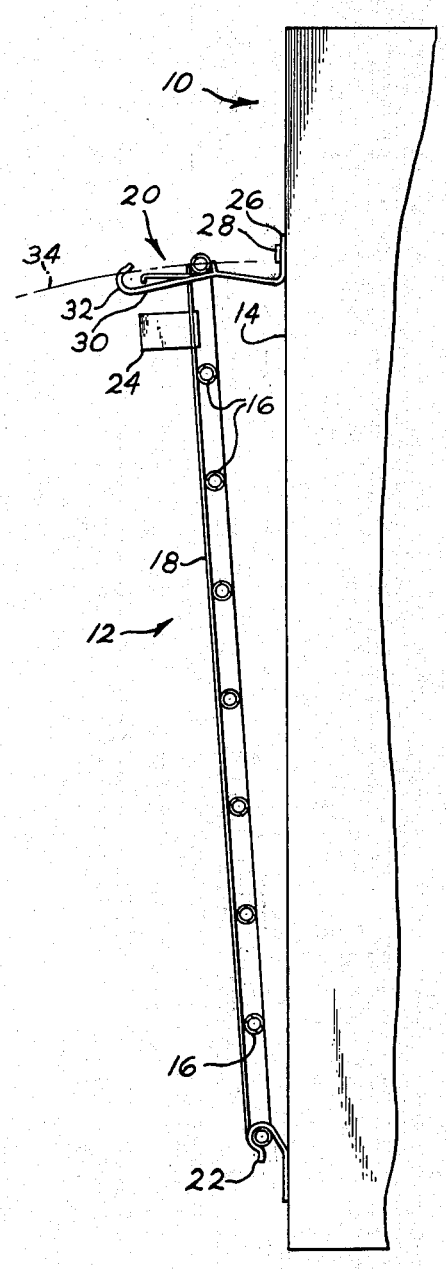
FIG. 2 is a diagrammatic partial side view of a natural draft refrigerator showing, in addition to the condenser holding clip, the condenser in the shipping and storage position, the holding clip being fully deformed.
Figure 3:
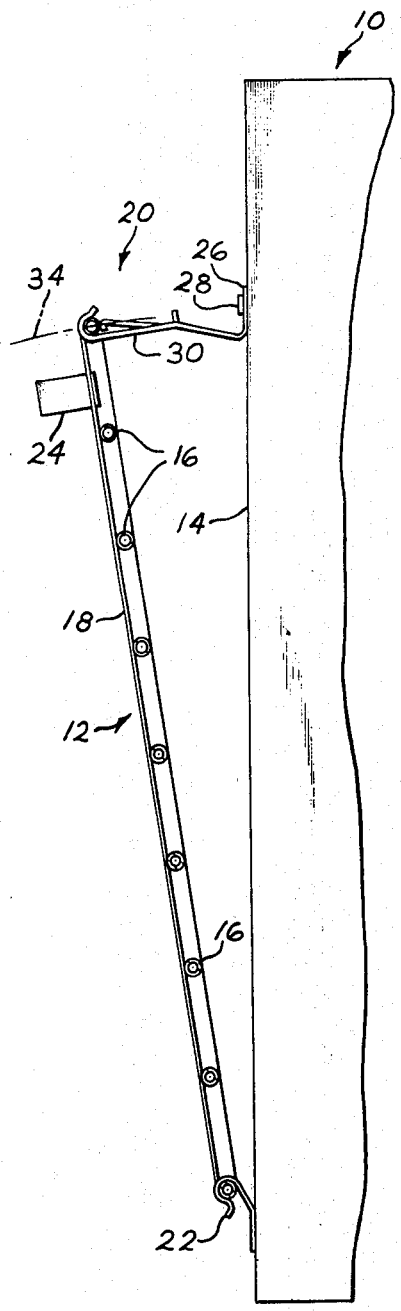
FIG. 3 shows a diagrammatic partial side view of a natural draft refrigerator showing, in addition to the condenser holding clip, the condenser in the in-use position, the holding clip being partially deformed.

Still referring to FIGS. 1–4, the clip 20 includes an attachment portion 26 fixedly attached by fastening means, such as a screw 28, to the refrigerator rear wall 14. The clip 20 also includes a middle portion 30 which a part of the condenser 12, such as a section of the tubing 16, contacts and moves along when the condenser 12 moves between the shipping and the in-use positions. The clip 20 further includes an end portion 32 which is generally of a J configuration and which prevents the condenser 12 from moving further than the in-use position from the rear wall 14, as is best shown in FIG. 3. In order to receive a section of the tubing 16, the inner diameter of the J shaped end portion 32 is slightly larger than the outer diameter of the tubing 16.

In FIGS. 1–3, there is shown, in broken lines, an arc 34 along which the part of the condenser 12 which contacts the clip 20 moves. The precise location in space of the arc 34 is defined by the location of the pivot 22 and the length of the condenser 12. The clip 20 is made of resilient material, for example spring steel, and is so constructed to cooperate with the condenser 12 to produce a resultant force which urges or biases the top of the condenser 12 along the arc 34 away from the rear wall 14 toward the in-use position. Additionally, means are provided for releasably holding the condenser 12 in the shipping position, which means may be a piece of temporary shipping tape 36 (FIG. 4).

In order to produce the force for biasing the condenser 12 toward the in-use position, the resilient clip 20 is constructed to assume an undeformed position prior to installation of the condenser 12, as is shown in FIG. 1; a partially deformed position when the condenser 12 is in the in-use position, as is shown in FIG. 3; and a fully deformed position when the condenser 12 is in the shipping position, as is shown in FIG. 2. In addition to biasing the condenser 12 toward the in-use position, the constant spring tension on the condenser 12 reduces the possibility of rattles.

Figure 5:
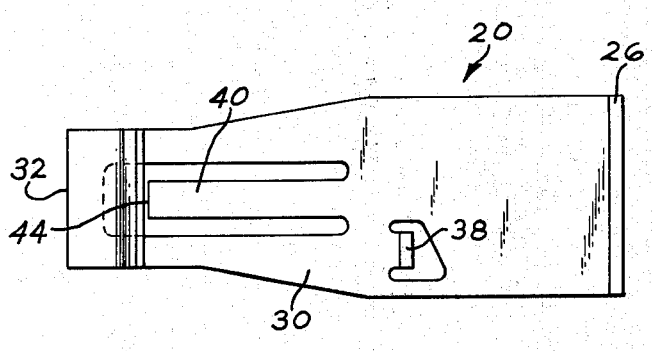
FIG. 5 is a top view of one embodiment of a condenser holding clip according to the invention.
Figure 6:
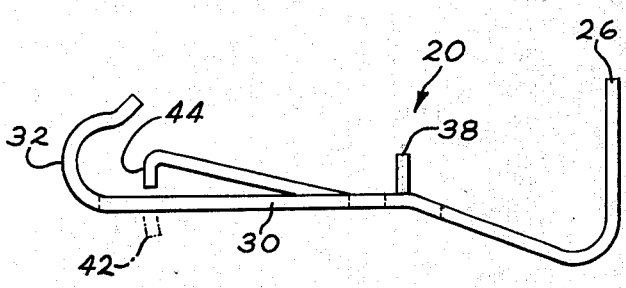
FIG. 6 is a side view of the condenser holding clip shown in FIG. 5.

Referring now to FIGS. 5 and 6, the clip 20 is shown in greater detail. In order to prevent the top of the condenser 12 from moving closer than the shipping position to the rear wall 14, the clip 20 includes a stop element such as a tab 38 extending generally perpendicularly from the middle portion 30. The tab 38 is preferably formed by cutting and bending a portion of the clip 20, but the stop element may be a separate element attached to the clip 20. When the condenser 12 is in the shipping position (FIG. 2), a part of the condenser 12 such as the tubing 16 contacts the tab 38, thereby maintaining the condenser spaced a sufficient distance from the rear wall 14 to minimize the possibility of damage due to forcible contact of the condenser 12 with the refrigerator rear wall 14 during shipping.

Still referring to FIGS. 5 and 6, the clip 20 further includes a locking element 40 attached to and positioned at the middle portion 30, the locking element 40 being free to move between a first position, shown by broken line 42 (FIG. 6), at which the condenser 12 is free to move, and a second position, shown by solid lines, at which the end 44 of the locking element 40 contacts the condenser 12 to maintain the condenser 12 in the in-use position. Preferably, the locking element 40 is formed on the clip 20 by cutting and bending a portion of the clip 20, similarly to the forming of the tab 38. Alternatively, the locking element 40 could be a separate element connected to the clip 20.

In the embodiment of the clip 20 and locking element 40 shown in FIGS. 5 and 6, unless the locking element 40 is exactly located on the center line of the tubing 16, with sufficient force the tubing 16 could be pushed back over the locking element 40 toward the shipping position. In order to overcome this problem, an alternative embodiment of the clip 20 may be employed.

Figure 7:
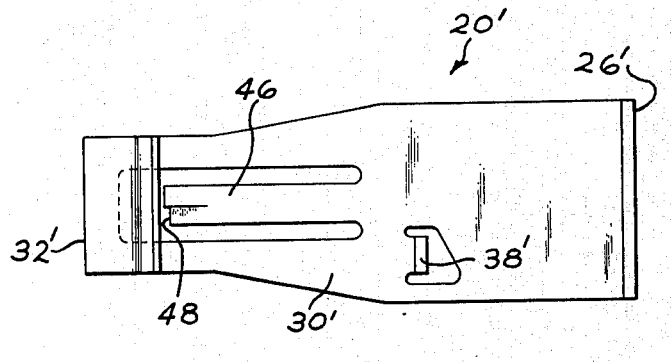
FIG. 7 is a top view of another embodiment of a condenser holding clip according to the invention.
Figure 8:
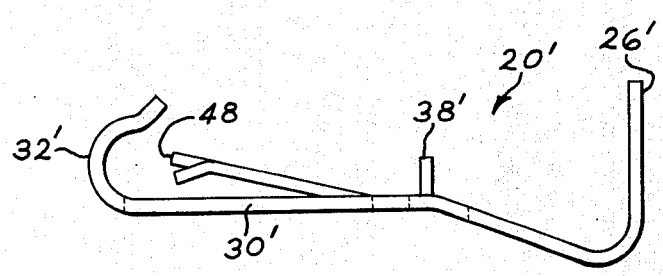
FIG. 8 is a side view of the condenser holding clip shown in FIG. 7.

Referring now to FIGS. 7 and 8, one alternative embodiment of the clip 20 is shown, the alternative embodiment of the clip 20 being designated 20'. In FIGS. 7 and 8, those elements of the clip 20' which are designated by primed reference numerals are unchanged, so a detailed description thereof will not be repeated. The clip 20' includes a locking element 46 which is movable between first and second positions, as is the locking element 40 (FIGS. 5 and 6). The end 48 of the locking element 46 is of forked configuration for contacting the condenser 12 at spaced-apart locations on opposite sides of plane passing through the axis of the tubing 16. Such a configuration holds the condenser 12 more securely in the in-use position than does the configuration of the clip 20 shown in FIGS. 1–6.

Having described preferred embodiments of the invention, the operation thereof will now be described. In the shipping position (FIGS. 2 and 4), the condenser 12 is in tension between the pivot 22 and the partially deformed clip 20 and is held in the shipping position against the tab 38 by the shipping tape 36. Comparing the refrigerator shown in the shipping condition (FIG. 2), and in the in-use condition (FIG. 3), it will be apparent that the refrigerator is reduced in depth in the shipping condition. In a preferred embodiment, the reduction in depth is one-half inch.

Upon installation, the shipping tape 36 is either cut or removed and the top of the condenser 12 is moved pivotally back against the end portion 32 to assume the in-use position.

As will now be explained, in the preferred embodiments of the invention, the clip 20 automatically urges or biases the condenser 12 toward the in-use position so the installer need only remove the shipping tape 36, and need not manually push the condenser 12 back. Because it is unlikely that the tape 36 would be left in place even by an inexperienced installer who may not known the importance of moving the condenser 12 to the in-use position, the possibility of the refrigerator 10 being placed into operation with the condenser 12 in the shipping position is minimized.

Since the clip 20 is deformed more when the condenser 12 is in the shipping position (FIG. 2) than when the condenser is in the in-use position (FIG. 3), more potential energy is stored in the clip 20 in the shipping position. When in the shipping position, the clip 20 tries to assume a state of lower potential energy by "springing back" to its undeformed position. Due to the geometrical construction of the apparatus, the only way in which potential energy in the clip 20 can be released is by movement of the condenser 12. Therefore, a resultant force is developed which biases the condenser 12 toward the in-use position.

Upon movement of the condenser 12 to the in-use position, the condenser tubing 16 causes the locking element 40 to deflect to the first position for entry of the tubing 16 into the J shaped end portion 32 of the clip 20. After the condenser tubing 16 passes, the locking element 40 returns to the second position with the end portion 44 in contact with the condenser tubing 16, thereby releasably locking the condenser 12 in the in-use position.

At the in-use position, the wall spacer element 24 maintains the condenser 12 spaced at least the predetermined distance from the adjacent wall of the room for the free flowing of air over the condenser.

A specific example of the manner in which savings can be realized through reduction in refrigerator size afforded by the present invention will now be considered. In a railroad car, refrigerators are typically placed side by side in three columns across the width of the car and stacked in two layers so that six refrigerators are included in each row along the length of the car. With one particular refrigerator model, not including the present invention, 21 rows (126 refrigerators) could be placed along the length of a 60-foot car, but this left about 23 inches of unused space. A reduction in depth of one-half inch for each row of refrigerators (afforded by the present invention), when added to the previously-existing 23 inches, frees up enough additional space to fit in an entire additional row of six refrigerators. Since refrigerators are relatively light compared to other products which may be shipped by rail, load limits are not reached and the "extra" six refrigerators ride essentially "free," resulting in an overall lower shipping cost per refrigerator. Additionally, a cost saving results due to lower carton cost for smaller cartons.

It will be apparent, therefore, that the present invention provides condenser holding apparatus which permits a natural draft refrigerator to occupy less space during shipping than during use, and which, further, permits the refrigerator to be installed with a minimum of time and effort.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. In a refrigerator of the type having a condenser located generally adjacent an outer wall of the refrigerator cabinet, a condenser mounting arrangement comprising:

a holding element which has at least two holding positions and which permits at least one end of the condenser to move between a shipping position, in which the one end of the condenser is close to the refrigerator wall, and an in-use position, in which the one end of the condenser is away from the refrigerator wall.

2. Apparatus according to claim 1, further comprising a wall spacer mounted on the condenser near the one end of the condenser and extending a preselected distance outwardly therefrom in a direction away from the refrigerator wall.

3. Apparatus according to claim 2, wherein the preselected distance is at least 0.3 in.

4. Apparatus according to claim 1, further comprising a condenser pivot located near the other end of the condenser and attached to the refrigerator wall.

5. Apparatus according to claim 4, wherein said holding element permits the top end of the condenser to move between the shipping position and the in-use position, and said pivot is located near the bottom end of the condenser.

6. Apparatus according to claim 1, wherein said holding element includes means for biasing the condenser toward the in-use position.

7. Apparatus according to claim 6, further including means for releasably holding the condenser in the shipping position.

8. Apparatus according to claim 6, wherein the condenser is adapted to be releasably held in the shipping position by temporary shipping tape.

9. Apparatus according to claim 1, wherein said holding element includes a means for releasably locking the one end of the condenser in the in-use position.

10. Apparatus according to claim 1, wherein said holding element includes a stop element for preventing the one end of the condenser from moving closer than the shipping position to the refrigerator wall.

11. Apparatus according to claim 1, wherein said holding element comprises a clip having an attachment portion for attachment to the refrigerator wall, a middle portion, and an end portion, said end portion being of a "J" configuration for preventing the one end of said condenser from moving farther than the in-use position from the refrigerator wall.

12. Apparatus according to claim 11, wherein said clip is made of resilient material, a part of the condenser contacts and moves along said middle portion of said clip when the condenser moves between the shipping and the in-use position, and said clip is deformed more when the condenser is in the shipping position than when the condenser is in the in-use position.

whereby the condenser is biased toward the in-use position.

13. Apparatus according to claim 11, wherein said clip includes a locking element positioned at said middle portion of said clip, said locking element being movable between a first position at which the one end of said condenser is free to move to said end portion of said clip and a second position at which said locking element contacts the condenser and maintains the condenser at said end portion of said clip.

14. Apparatus according to claim 13, wherein the end of said locking element is of forked configuration for contacting the condenser at spaced-apart locations.

15. Apparatus according to claim 11, wherein said clip includes a stop element adapted for contacting the condenser to prevent the condenser from moving closer than the shipping position to the refrigerator outer wall.

* * * * *